United States Patent [19]

Gardner

[11] Patent Number: 4,829,894

[45] Date of Patent: May 16, 1989

[54] BALLOON PRINTING MACHINE

[75] Inventor: Max E. Gardner, Ashland, Ohio

[73] Assignee: Polyplate, Inc., Ashland, Ohio

[21] Appl. No.: 100,478

[22] Filed: Sep. 24, 1987

[51] Int. Cl.[4] ..... B41F 17/00

[52] U.S. Cl. ..... 101/35; 101/123; 101/126

[58] Field of Search ..... 101/35, 123, 126

[56] References Cited

U.S. PATENT DOCUMENTS

| | | | |
|---|---|---|---|
| 1,470,962 | 10/1923 | Dibble et al. | 101/123 X |
| 1,870,825 | 8/1932 | Sprague . | |
| 1,988,662 | 1/1935 | Myers | 101/36 |
| 2,016,450 | 10/1935 | Myers | 101/35 |
| 2,207,818 | 7/1940 | Perry et al. | 101/123 |
| 2,571,685 | 10/1951 | D'Autremont | 101/123 |
| 2,645,870 | 7/1953 | Smith et al. | 41/1 |
| 2,783,709 | 3/1957 | Thomas | 101/123 |
| 2,863,382 | 12/1958 | Giani | 101/123 |
| 3,224,364 | 12/1965 | Terzuoli | 101/37 |
| 3,370,569 | 2/1968 | Runge | 101/123 X |
| 3,391,803 | 7/1968 | Poulacs | 214/1 |
| 3,543,679 | 12/1970 | Wahl | 101/123 X |
| 3,868,899 | 3/1975 | Nye et al. | 101/35 |
| 3,946,668 | 3/1976 | Douthwaite et al. | 101/123 |
| 4,305,331 | 12/1981 | Colapinto | 101/126 X |
| 4,463,673 | 8/1984 | Moore | 101/126 X |
| 4,478,142 | 10/1984 | Santorineos | 101/35 |
| 4,648,317 | 3/1987 | Bubley et al. | 101/123 |

FOREIGN PATENT DOCUMENTS

| | | | |
|---|---|---|---|
| 159347 | 9/1984 | Japan | 101/123 |
| 1082622 | 3/1984 | U.S.S.R. | 101/123 |

*Primary Examiner*—Clifford D. Crowder

*Attorney, Agent, or Firm*—Renner, Otto, Boisselle & Sklar

[57] ABSTRACT

A compact machine consistently prints sharp, silk screened images on balloons. This is accomplished by a machine with a rotatable table and a number of operating stations located around the perimeter of the table. One station inflates the balloons to a predetermined size. At a print station a silk screen is lowered onto the balloon and a wiper makes a single pass across the screen to print on the balloon. (On the succeeding balloon the wiper will move in the opposite direction.) The wiper moves in a direction transverse to the usual orientation of lines of print on a balloon. The single pass printing and the direction with respect to the usual printed image orientation assure sharp images over extended printings. The balloon remains inflated and dries for about the next one-half rotation of the table, and it is then discharged onto a conveyor where infrared heat shrinks it to its original size.

13 Claims, 10 Drawing Sheets

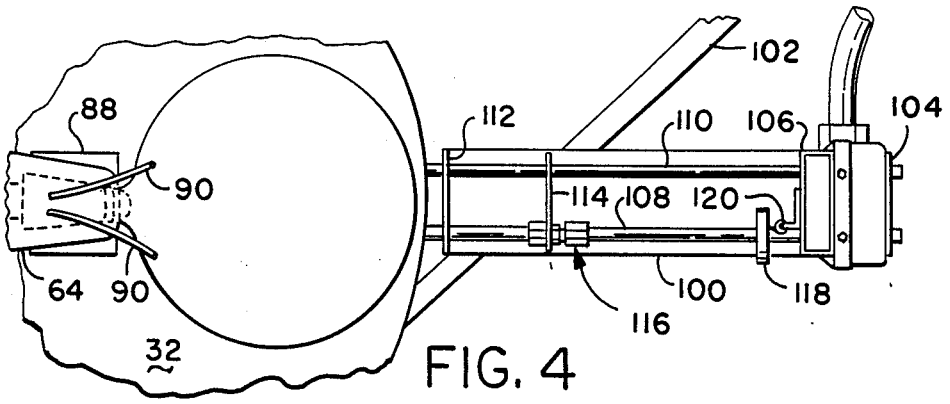
FIG. 4
FIG. 5A
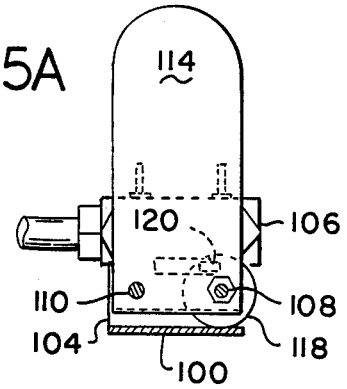
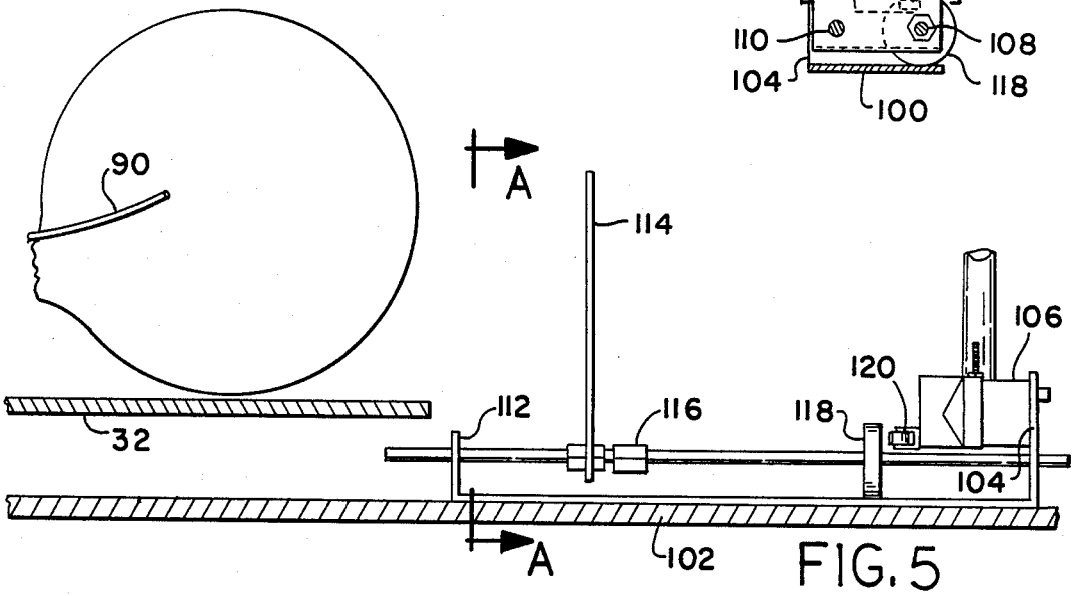
FIG. 5

FIG. 10
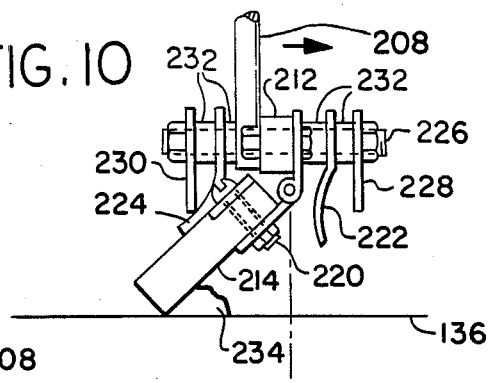
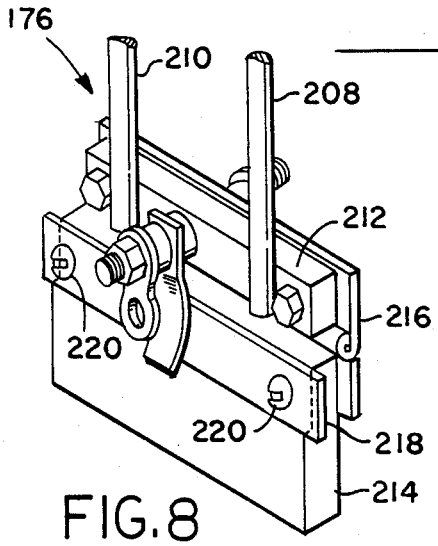
FIG. 8
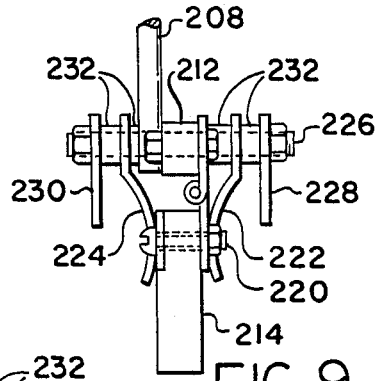
FIG. 9
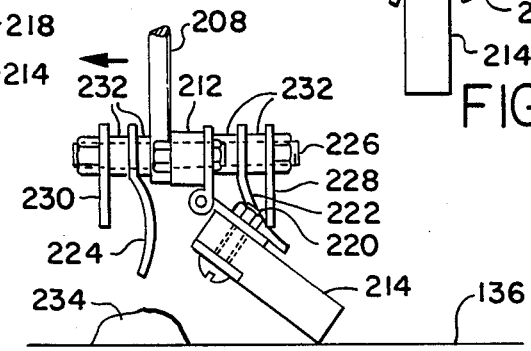
FIG. 11
FIG. 12
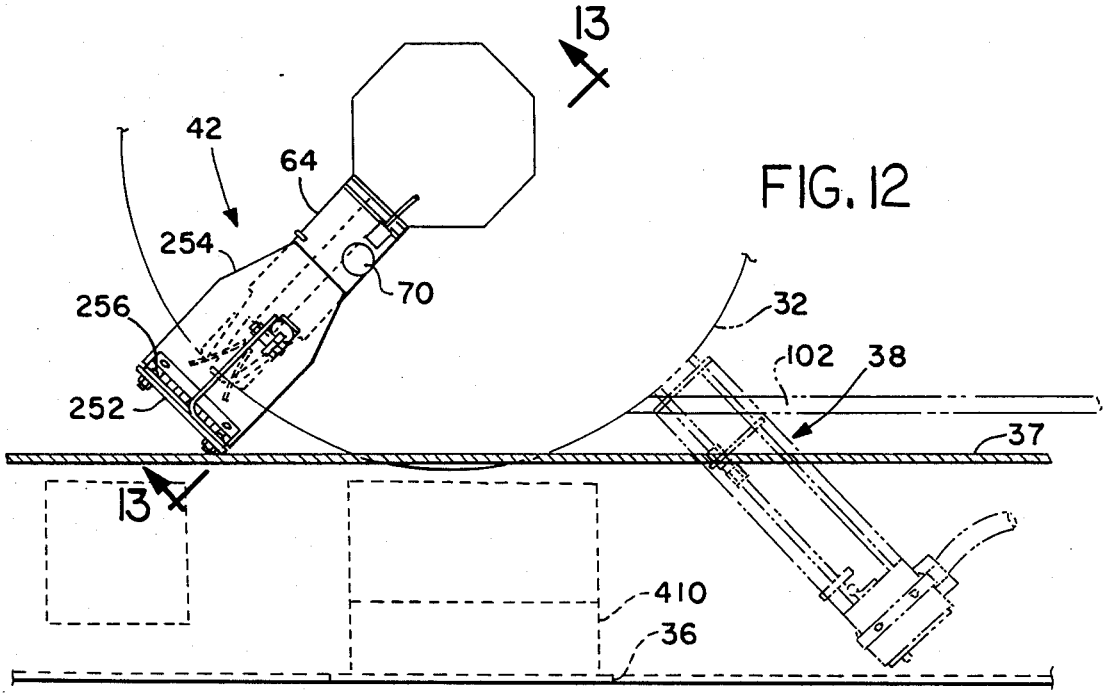

BALLOON PRINTING MACHINE

FIELD OF THE INVENTION

The present invention relates generally to printing machines and more specifically to machines for printing on balloons.

BACKGROUND OF THE INVENTION

Many machines have been designed and built for printing on balloons. Examples of these machines are shown in U.S. Pat. Nos. 1,988,662; 2,645,870; 3,224,364; 3,868,899; and 4,478,142. These prior art machines typically have a plurality of stations. At one the balloon is gripped and inflated; at another it is printed; and finally the balloon is discharged from the machine. Other strategies for manipulating or printing an inflated or inflatable object are illustrated in U.S. Pat. Nos. 1,870,825; 2,016,450; and 3,391,803.

Some of these machines use an offset method of printing, one uses a direct transfer type of printing, and one uses a silk screen. The offset machines are relatively compact, but the image they produce is not as clear and sharp as the silk screened image. The silk screening type of apparatus may produce a sharp image, but it has heretofore been excessively large.

Further, the known silk screening devices have had a tendency to have the image printed degrade after a relatively few printing cycles. This is believed to occur because the squeegee or wiper of the silk screening device always travels in the same direction when printing. This causes ink to build up on one edge of the image on the silk screen, and this edge then does not print cleanly.

SUMMARY OF THE INVENTION

The present invention overcomes the problems of the prior art machines by providing a compact machine which consistently prints sharp, silk screened images. This is accomplished by a machine with a rotatable table and a number of operating stations located around the perimeter of the table. One station inflates the balloons to a predetermined size. At a print station a silk screen is lowered onto the balloon and a wiper makes a single pass across the screen to print on the balloon. (On the succeeding balloon the wiper will move in the opposite direction.) The balloon remains inflated and dries for about the next one-half rotation of the table, and it is then discharged onto a conveyor where infrared heat shrinks it to its original size.

The machine of the present invention is readily adaptable to balloons of different sizes. All that is necessary is to adjust a paddle which is contacted when the balloon is full at the inflation station and to make a corresponding adjustment to the vertical motion of the silk screen at the printing station.

BRIEF DESCRIPTION OF THE DRAWINGS

In the annexed drawings:

FIG. 4 is a plan view of an inflation station forming a part of the balloon printing machine of FIG. 1;

FIG. 5 is an elevation view of the inflation station of FIG. 4;

FIG. 5A is a view looking generally in the direction of arrows A—A of FIG. 5;

FIG. 8 is a perspective illustration of a wiper assembly forming a part of the print station of FIG. 6;

FIG. 9 is a side elevation view of the wiper assembly of FIG. 8 shown out of contact with a silk screen with which it is intended to cooperate;

FIGS. 10 and 11 show the wiper assembly of FIG. 9 moving in first one direction and then the opposite direction pushing a pool of ink in front of it in each case;

FIG. 12 is a plan view of a discharge station forming a part of the balloon printing machine of FIG. 1;

DESCRIPTION OF PREFERRED EMBODIMENT

Figure 1:
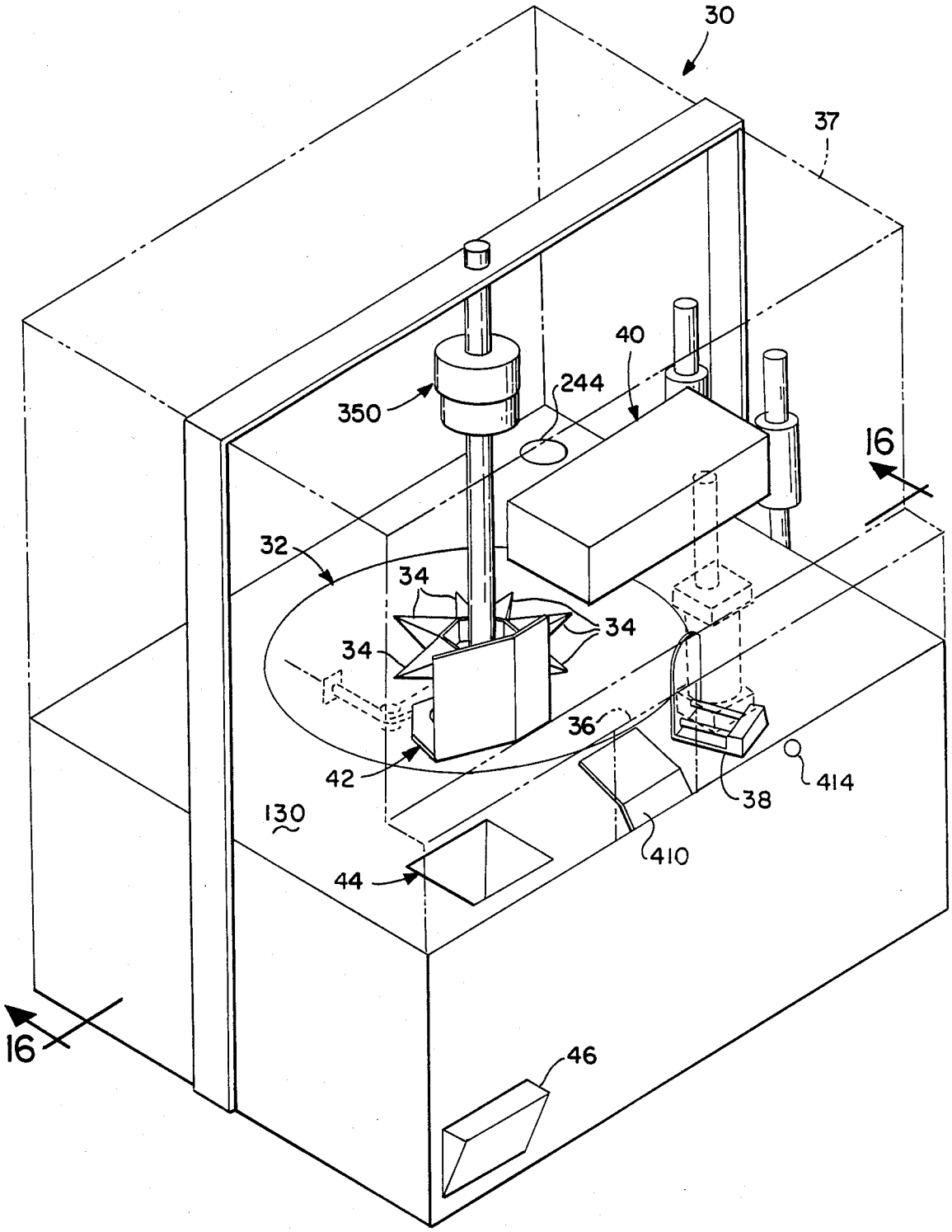
FIG. 1 is a perspective, schematic view of a balloon printing machine constructed in accordance with the present invention.

The balloon printing machine 30 illustrated in FIG. 1 is adapted to inflate and apply a silk screened image to a balloon. Thereafter the balloon is bathed in warm air for a short period of time to facilitate drying of the image and then the balloon is discharged to be warmed under an infrared heater to shrink it back to its original size. To this end the balloon printing machine 30 includes a rotatable table 32 to which are mounted eight gripper means 34. An operator inserts an uninflated balloon through a window 36 in the housing 37 of the machine 30. The housing 37 is shown in phantom in FIG. 1 in order that the chief operating elements of the machine may be illustrated. The housing 37 is formed of sheet and serves to mount some components of the machine, to contain warm air which is directed toward the drying balloons, to protect workers from the moving parts of the machine, and to protect against the possible bursting of a balloon during the printing operation.

Once a balloon has been placed on one of the eight gripper means 34, the rotatable table 32 turns one-eighth of a revolution so that the balloon is addressing the inflation station 38. Thereupon the balloon is inflated to a predetermined size. When this has occurred, the rotatable table 32 turns another one-eighth turn so that the inflated balloon is directly beneath the print station means 40. The print station means 40 then is lowered vertically onto the balloon, flattening the balloon's surface against a silk screen. Then a wiper assembly in the print station means travels once across the silk screen to transfer ink to the inflated balloon. Thereafter, the rotatable table 32 carries the inflated balloon around a little more than 180° while the balloon is bathed in warm air. This gives the image time to dry sufficiently. Then the balloon is discharged at discharge station 42. The balloon next travels through a heater 44 which shrinks the balloon to its original size and then discharges the printed balloon through an exit opening 46. Each of these stations as well as the control system will be discussed in turn below.

Figure 2:
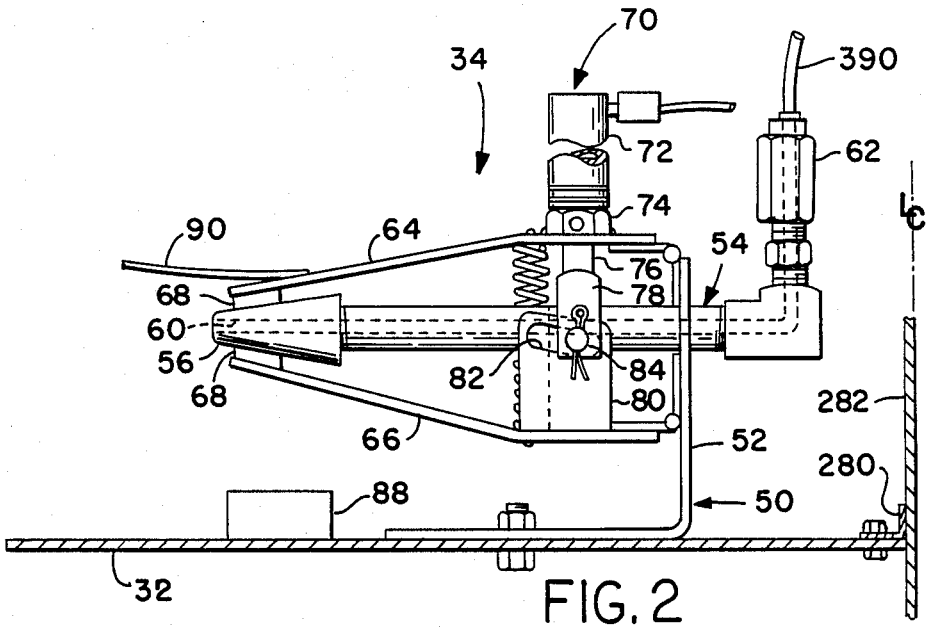
FIG. 2 is an elevation view of a gripper assembly forming a part of the balloon printing machine of the present invention.
Figure 3:
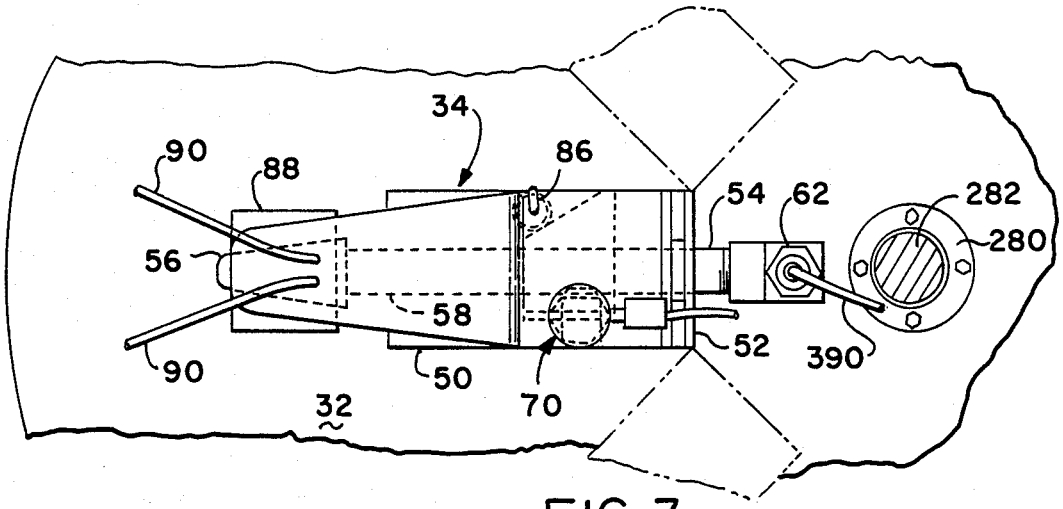
FIG. 3 is a plan view of the gripper assembly of FIG. 2.

FIGS. 2 and 3 illustrate in elevation and plan view, respectively, one of the eight gripper means 34 mounted to the rotatable table 32. Each of the eight gripper means 34 is identical, and they are uniformly spaced, facing radially outward from the center of the rotatable table 32. Accordingly, the rotatable table 32 can grip simultaneously eight balloons.

Each gripper means 34 includes an L-shaped bracket 50 secured to the rotatable table 32 by any suitable means. The bracket 50 includes an upstanding leg 52 which is perpendicular to the plane of the rotatable table 32, and to this leg a nozzle assembly 54 is mounted. The nozzle assembly 54 includes a tapered nozzle tip 56 mounted to a conduit 58. The conduit 58 is suitably secured to the upstanding leg 52 of the bracket 50 so that the conduit 58 is parallel to the plane of the rotatable table 32 and generally radially oriented.

Figure 22:
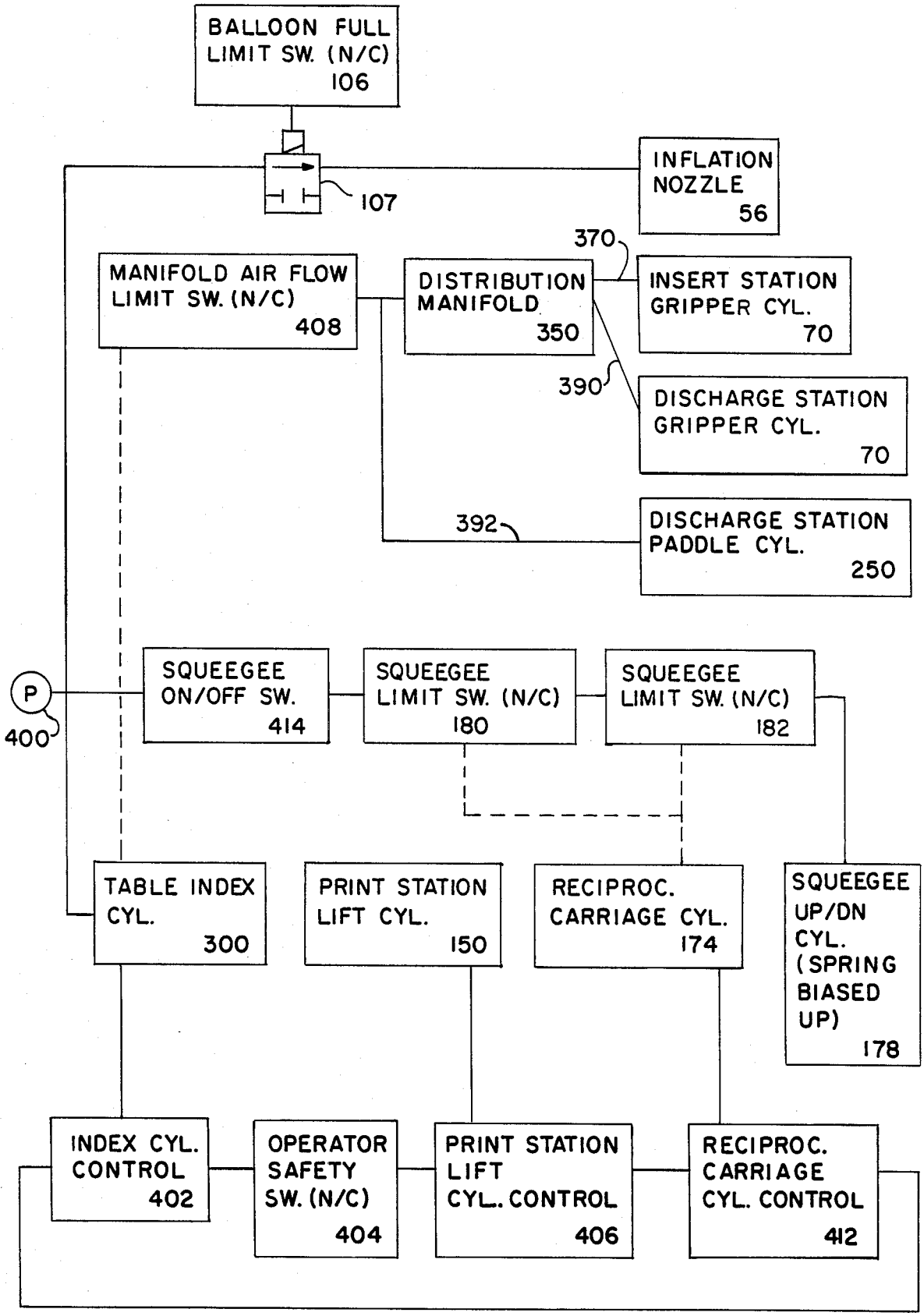
FIG. 22 is a schematic drawing illustrating the control circuitry of the printing machine of FIG. 1.

The nozzle tip 56 is proportioned to receive the neck of a balloon, and the nozzle tip 56 has an internal passage 60 which communicates with the conduit 58 to a suitable supply of compressed air (shown schematically at 400 in FIG. 22). In addition, each nozzle assembly 54 (FIGS. 2 and 3) includes a check valve 62 which retains air in a balloon once the balloon has been inflated. To inflate a balloon, the neck of the balloon is placed over the nozzle tip 56 and air is directed through the check valve 62, conduit 58 and nozzle tip 56 into the balloon. The operation of the check valve 62 retains air in the balloon even when the air supply has been disconnected.

The gripper means 34 also includes an upper gripper finger 64 and a lower gripper finger 66 to retain the neck of a balloon on the nozzle tip 56. The gripper fingers 64 and 66 are connected by hinges to the upstanding leg 52 of the bracket 50 and are equally spaced above and below the conduit 58. At its distal end, each gripper finger 64, 66 carries a foam pad 68 to press against the tapered sides of the nozzle tip 56.

The gripper fingers 64 and 66 are movable between a closed position (shown) and an open position (shown in FIG. 14) by means of a pneumatic cylinder assembly 70. The pneumatic cylinder assembly 70 (FIGS. 2 and 3) includes a cylinder portion 72 which is threaded to a nut 74 welded to the upper gripper finger 64. The pneumatic cylinder assembly 70 also includes a piston rod 76 which passes through a passage in the upper gripper finger 64 and terminates with a clevis 78 which engages a bracket 80 welded to the lower gripper finger 66. The bracket 80 is formed with a generally horizontal slot 82 through which a pin 84 extends. The pin 84 serves to connect the clevis 78 to the bracket 80.

When pneumatic pressure is applied to the cylinder assembly 70, the piston rod 76 extends moving the upper and lower gripper fingers 64 and 66, respectively, away from each other and thus separating the foam pads 68 from engagement with the nozzle tip 56. This permits the neck of a balloon to be placed in or removed from the nozzle tip. Once the air pressure within the pneumatic cylinder assembly 70 is relieved, a coil spring 86 connected between the gripper fingers 64 and 66 pulls the gripper fingers toward each other until the foam pads 68 engage the neck of a balloon on opposite sides of the nozzle tip 56.

In order to reduce the amount of operating noise made by the gripper means 34, a cushion 88 is mounted on the rotatable table so that the lower gripper finger 66 need not bang into the rotatable table 32 when the gripper means is wide open.

The upper gripper finger 64 also carries a pair of guide wires 90 which project outwardly from its distal end. These guide wires 90 are gently flared or curved to support an inflated balloon to position it generally radially of the nozzle tip.

As will be discussed in greater detail below, the balloon printing machine 30 is operated so that the upper and lower gripper fingers 64 and 66 move to their open or separated position when the nozzle assembly with which they are associated is aligned with the window 36 (FIG. 1). This permits the operator to position a balloon over the nozzle tip 56. Thereafter, the gripper fingers 54 and 56 close upon the neck of the balloon and the rotatable table is turned one-eighth of a turn so that it is brought into alignment with the inflation station 38.

FIGS. 4, 5, and 5A show the inflation station 38. The inflation station 38 includes a shallow U-shaped bracket 100 which is mounted to a horizontal member 102 of the machine frame and which is oriented generally radially with respect to the rotatable table 32. An upstanding leg 104 of the U-shaped bracket 100 carries a microswitch 106. This microswitch is connected to a solenoid valve 107 (FIG. 22) which controls the flow of air into the nozzle assembly 54 (FIGS. 2 and 3). The solenoid valve 107 (FIG. 22) and microswitch 106 (FIGS. 4–5A) are arranged so that when the microswitch 106 is contacted, the flow of air through the nozzle assembly 54 (FIGS. 2 and 3) stops.

The U-shaped bracket 100 (FIGS. 4–5A) carries a pair of parallel rods 108 and 110. These rods are parallel to each other and to a radius of the rotatable table 32. The rods 108 and 110 are axially slidable through openings formed in the upstanding leg 104 and the opposite upstanding leg 112. A paddle 114 extends upward from the rods 108 and 110. The rods 108 and 110 are mounted slightly below the plane of the rotatable table 32, but the paddle 114 extends well above this plane. The paddle 114 is positioned so that when a balloon is fully inflated, the balloon touches the paddle. The paddle 114, being connected to the shaft 108, moves radially outward in response to the pressure from the balloon as the balloon expands. This action triggers the microswitch 106 to shut off air to the balloon.

The paddle 114 is adjustably mounted on the shafts 108 and 110 by means of a gland nut assembly 116. This gland nut assembly 116 allows the paddle 114 to be positioned axially at any desired location along the length of rods 108 and 110, thereby to accommodate balloons of various sizes. The rod 108 also carries a disc 118 a portion of which overlaps the actuator 120 of the microswitch 106. When the paddle 114 moves the rod 108 backwards, the disc 118 contacts the microswitch actuator 120 which in turn terminates the flow of air into the balloon.

The inflation station, by reason of the paddle 114 being adjustably positioned on the rods 108 and 110, is effective to inflate balloons to a uniform size. An inflator which utilized a pressure responsive valve to sense when balloons were properly inflated would not necessarily inflate balloons to the same size because of variations in the balloons themselves. The present arrangement assures that balloons of uniform size will be presented at the print station means 40.

Figure 6:
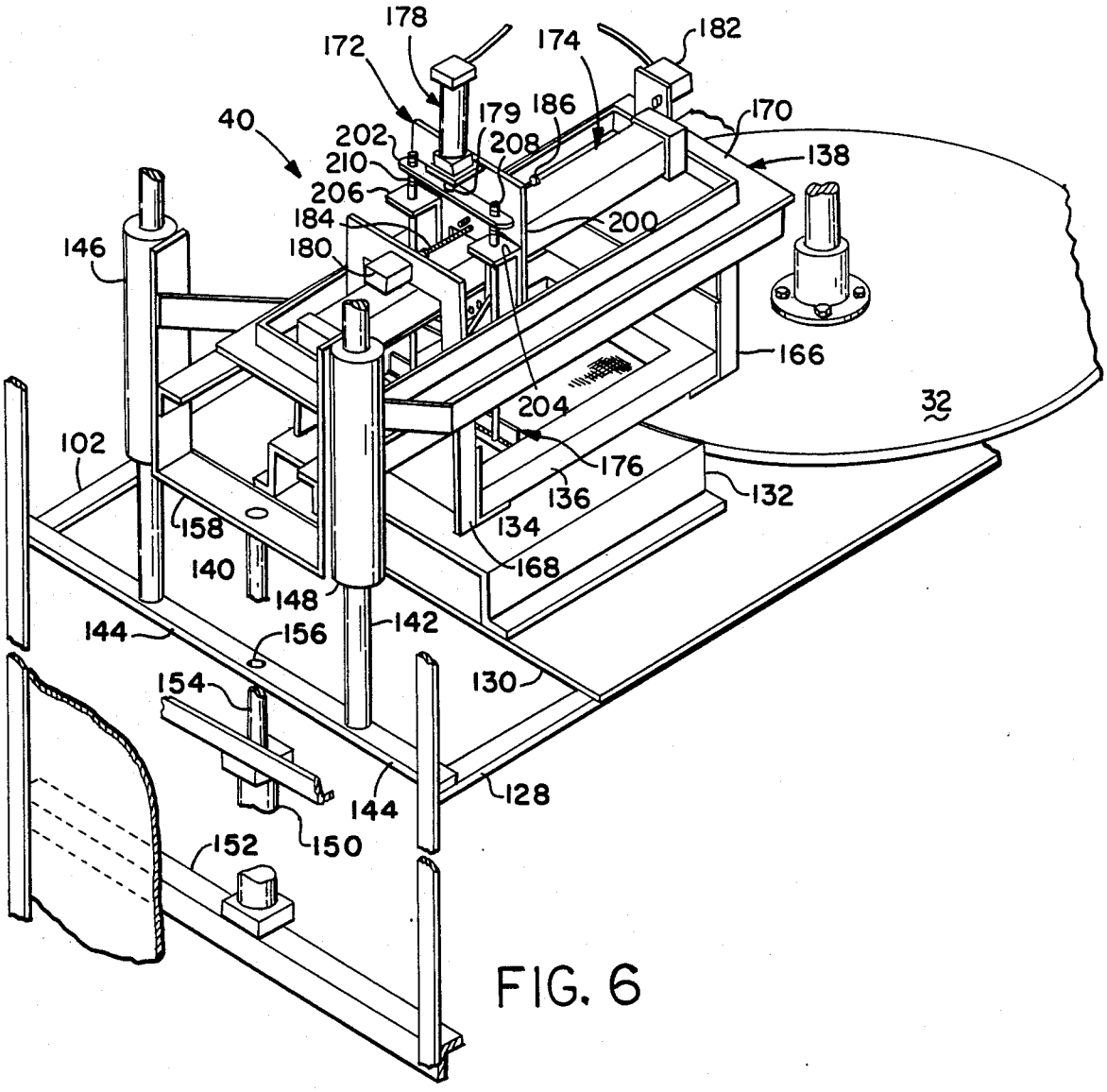
FIG. 6 is a perspective illustration of a print station forming a portion of the balloon printing machine of FIG. 1.

The print station means 40 (FIG. 1) is immediately adjacent the inflation station 38 and is 90° from the window 36 where balloons are installed on the gripper means 34. At the print station 40 (FIG. 6) the front horizontal frame member 102 and a parallel rear horizontal frame member 128 support a plate 130 parallel to and below the plane of the rotatable table 32. A balloon support 132 is mounted to the plate 130 and has an upper support surface 134 which is coplanar with the plane of the rotatable table 32. As will be seen, during printing, the balloon is pressed against the support 132 by the print station means 40.

Figure 7A:
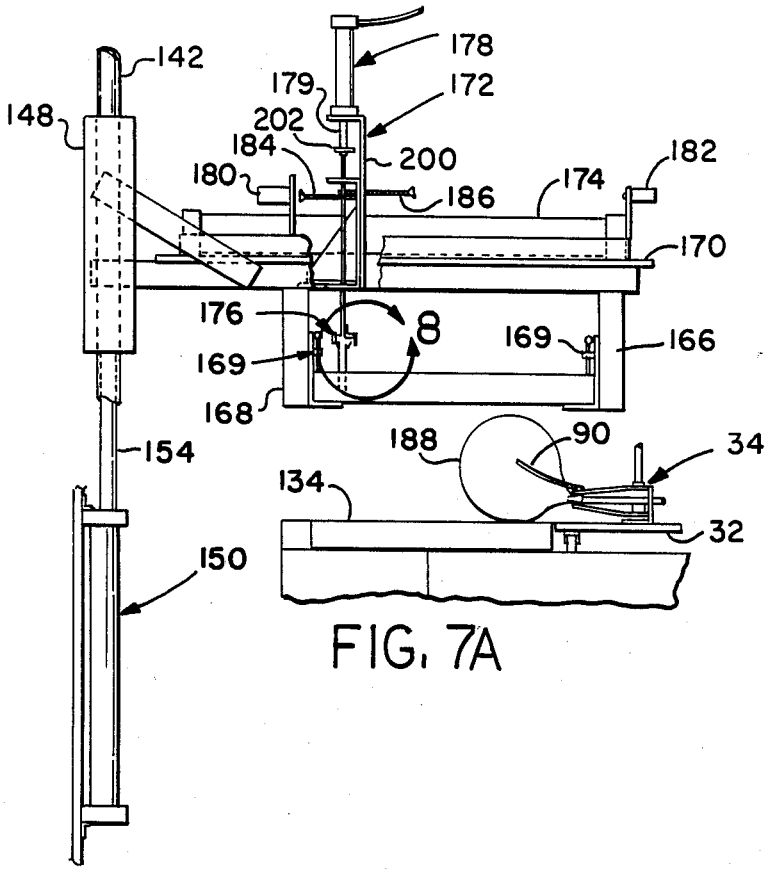
FIG. 7A is an elevation view of the print station of FIG. 1 shown with a balloon in position and with the print station elevated.

The print station means 40 includes a silk screen 136 which is mounted in a screen frame assembly 138 and is generally parallel to the support surface 134 of the balloon support 132. The screen frame assembly 138 is mounted for vertical movement perpendicular to the upper support surface 134 to bring the silk screen 136 into and out of engagement with a balloon as illustrated in FIGS. 7A and 7B.

To this end a pair of guide bars 140 and 142 (FIG. 6) are fixed to a frame cross member 144 which extends between the front and rear horizontal frame members 102 and 128, respectively. The screen frame assembly 138 includes a pair of linear ball bearings 146 and 148 which are mounted on and slide with respect to the guide bars 140 and 142, respectively. A pneumatic cylinder assembly 150 is mounted to a lower frame cross member 152. This cylinder assembly may be termed the print station lift cylinder. It includes a piston rod 154 which extends through an opening 156 in the cross member 144 and is fixedly connected with a U-shaped bracket 158 which extends between and connects the linear ball bearing assemblies 146 and 148. Extension or retraction of the piston 154 therefore serves to raise or lower the screen frame assembly 138 to move it between the positions illustrated in FIGS. 7A and 7B.

The screen frame assembly 138 includes brackets 166 and 168 which support the silk screen 136. Clamps 169 (FIGS. 7A and 7B) releasably secure the silk screen to the brackets 166 and 168. The screen frame assembly also includes a rectangular frame 170 which is rigidly connected to the U-shaped bracket 158. The rectangular frame 170 defines a plane generally parallel to that of the silk screen 136 and above it. A reciprocating carriage assembly 172 is mounted to a rodless reciprocating carriage cylinder 174 which in turn is mounted to opposite ends of the rectangular frame 170. The reciprocating carriage assembly 172 carries a wiper or squeegee assembly 176 and an up/down actuating cylinder 178 which raises or lowers the wiper assembly 176 into or out of engagement with the silk screen surface. The piston 179 of the up/down cylinder 178 is spring biased upward and air pressure applied to the cylinder 178 lowers the wiper assembly 176 onto the silk screen surface.

Normally closed limit switches 180 and 182 are provided to control the flow of air to the up/down actuating cylinder 178 and at the same time to control the stroke of the carriage cylinder 174. A bolt 184 is secured to a threaded passage in the carriage assembly 172 and is in alignment with the limit switch 180. When the head of the bolt 184 contacts the limit switch 180, the operating pressure within the cylinder 174 spikes upward and this spike triggers a control circuit (shown schematically at 412, FIG. 22) to stop the motion of cylinder 174. At the same time contact between bolt 184 (FIG. 6) and limit switch 180 opens this normally closed limit switch and shuts off air pressure to cylinder 178. The spring within cylinder 178 then lifts the wiper assembly 176 from the silk screen.

A similar bolt 186 cooperates with the limit switch 182 to define the end of movement of the carriage assembly 172 in the opposite direction (toward the upper right in FIG. 6) and to lift the wiper assembly 176 from the silk screen at the end of the stroke in that direction. The bolts 184 and 186 may be adjusted lengthwise to vary the stroke of the carriage cylinder 174 and thus of the carriage assembly 172 in accordance with the size of the balloon to be printed and the size of the image to be printed on it.

The reciprocating carriage assembly 172 is mounted directly to the driven portion of a conventional, commercially available rodless cylinder 174. For example, the cylinder 174 may be a rodless pneumatic cylinder type 200/20 manufactured by Origa Corporation, Elmhurst, Illinois.

Figure 7C:
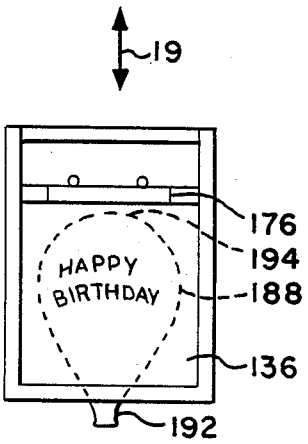
FIG. 7C is a plan view of a silk screen which forms a part of the print station illustrating motion of a wiper assembly in the direction of a line extending from the apex to the neck of the balloon.
Figure 7B:
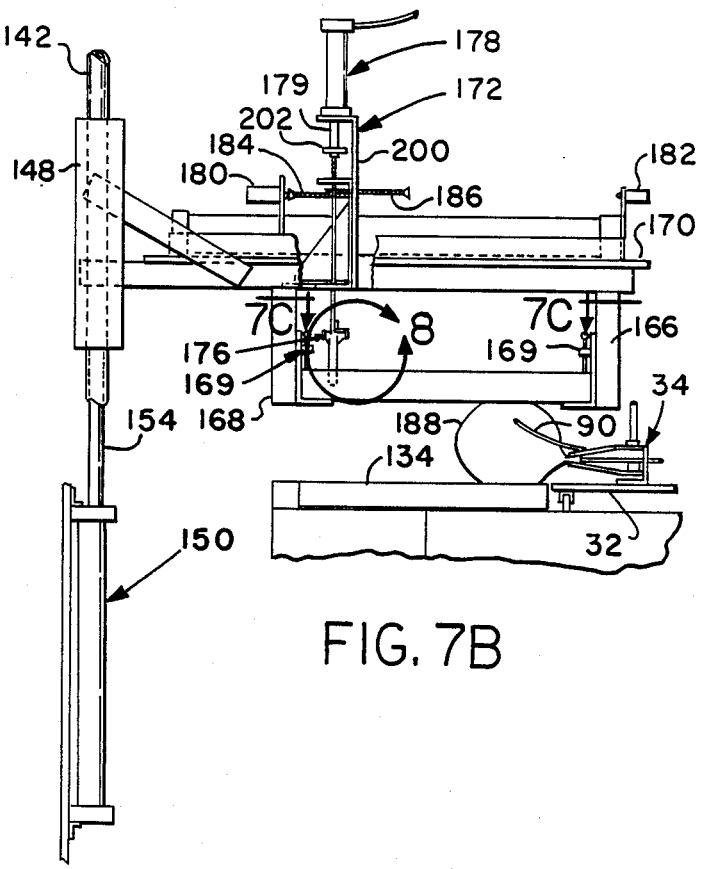
FIG. 7B is a view generally similar to FIG. 7A but showing the print station lowered onto the balloon and ready to print.

The arrangement and orientation of the cylinder 174 with respect to the gripper assembly 34 which grips a balloon 188 at the print station means 40 is such that the wiper assembly 176 moves in the direction of arrow 190 parallel to a line connecting the neck 192 of the balloon and its apex 194 (FIG. 7C). This provides a generally sharper image than if the wiper assembly 176 moved perpendicularly to arrow 190 because in most balloon writing the letters are arranged to be read from left to right when the neck 192 of the balloon is down and the balloon apex 194 is uppermost. In this orientation there is more space between horizontal rows or lines of letters than there is lateral space between the letters within a row. For example, in FIG. 7C there is more vertical space between the two "P"s and the "TH" in the next row down than there is between the two "P"s themselves. This is important because any ink that does accumulate at the boundaries of image and non-image areas on the silk screen 136 does so at boundaries which are transverse to the direction of wiper assembly movement. The arrangement of the present invention assures that the accumulation, if any, is along boundaries that are generally more widely separated than if the wiper assembly moved across the silk screen transverse to arrow 188. The result is that any blurring of the printed image caused by ink accumulation is in the part of the image where it will do the least harm.

The carriage assembly 172 includes a vertical plate 200 mounted by appropriate brackets and fittings to the carriage cylinder 174. The cylinder 178 is mounted on the plate 200 and arranged with its piston rod 179 generally vertical. A cross bar 202 is connected to the piston rod 179. A pair of guides 204 and 206 are also mounted to the plate 200 and support rods 208 and 210 for generally vertical movement. The rods 208 and 210 are connected to opposite ends of the cross bar 202 and serve to transmit vertical movement of the piston rod 179 of cylinder assembly 178 to the wiper assembly 176.

The wiper assembly 176 (FIGS. 8–11) includes a cross bar 212 welded to rods 208 and 210 and a rubber squeegee 214 flexibly mounted to the cross bar 212 by means of a hinge 216. The rubber squeegee 214 is clamped to the hinge by means of a compressor plate 218 and a pair of threaded fasteners 220. A pair of flat, metal biasing springs 222 and 224 bias the squeegee 214 into a generally vertical alignment with the rods 208 and 210. The biasing springs are mounted on a bolt 226 which passes through the cross bar 212. In addition, stops 228 and 230 are mounted to bolt 226. Appropriate spacers 232 separate the stops from the springs and the springs from the cross bar.

When the wiper actuating cylinder 178 is actuated to lower the rods 208 and 210, the squeegee 214 is pressed against the silk screen, and further downward movement makes it necessary for the hinge 216 to pivot one way or the other from vertical against the bias of one of the springs 222 and 224. Which direction the hinge 216 rotates depends on the direction of travel of the carriage assembly 172. As illustrated in FIG. 10, when the carriage assembly moves to the right the hinge 216 pivots clockwise, bending hinge 224 out of its normal position until further movement is blocked by contact between the rubber squeegee 214 and stop 230. On the other hand, when the carriage assembly moves to the left, spring 222 is compressed as the squeegee 214 rotates counterclockwise until further movement is stopped by engagement with stop 228.

As pointed out above, the flow of air to cylinder 178 is controlled by switches 180 and 182 which are normally closed to permit air to flow to cylinder assembly 178 except when one of the bolts 184 or 186 is contacting one of them. Through this arrangement downward movement of the squeegee assembly 176 cannot begin until after the reciprocating carriage cylinder 174 has started lateral movement. This lateral movement prior to any extension of piston 179 assures that the squeegee 214 will fold to one side or the other depending on the direction of lateral movement.

As was noted earlier, the print station means 40 prints with a single stroke of the wiper assembly 176, and the hinged arrangement of the squeegee 214 is a key factor in making this possible. When the carriage assembly carrying the squeegee 214 moves in a first direction, e.g., to the right as in FIG. 10, a pool of ink 234 is swept along in front of the squeegee. At the end of the stroke, the piston 179 retracts lifting the squeegee from contact with the silk screen and leaving the pool of ink where it was. Upon the return stroke to the left as viewed in FIG. 11, the squeegee 214 is again lowered to the silk screen, but this time it folds in the opposite direction so that it makes initial contact with the silk screen spaced from the pool of ink left at the end of the previous stroke. In this way, the same pool of ink is pushed first in one direction and then in the opposite direction across the silk screen. By printing with the squeegee 214 moving in alternate directions, excessive build-up of ink on one side of the image formed on the silk screen is avoided and therefore clear print quality is maintained even on extended printing runs.

Figure 15:
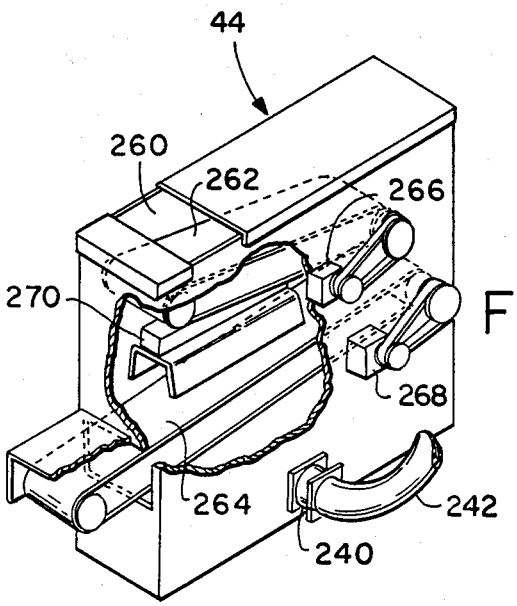
FIG. 15 is a partly cut away perspective illustration of a dryer with infrared heater forming a part of the printing machine of FIG. 1.

After a balloon has had an image printed on it, the screen frame assembly 138 (FIG. 6) is lifted by actuation of the cylinder assembly 150. Thereafter the rotatable table 32 (FIG. 1) is again advanced. The first three stations of the balloon printing machine occupy the first 90° of rotation of the rotatable table 32. Thereafter, there are no further operating stations until the balloon reaches the discharge station 42 located approximately 45° before the window 36. During this time the printed balloon is bathed in warm air to help in drying the ink. Warm air from the heater 44 (FIGS. 1 and 15) is pumped by fan 240 (FIG. 15) through a flexible conduit 242 into the space between plate 130 (FIG. 1) and the housing 37 through opening 244 in the plate 130. By the time the table 32 has rotated from the print station means 40 to the discharge station means 42, the inked image on the balloon has dried.

Figure 13:
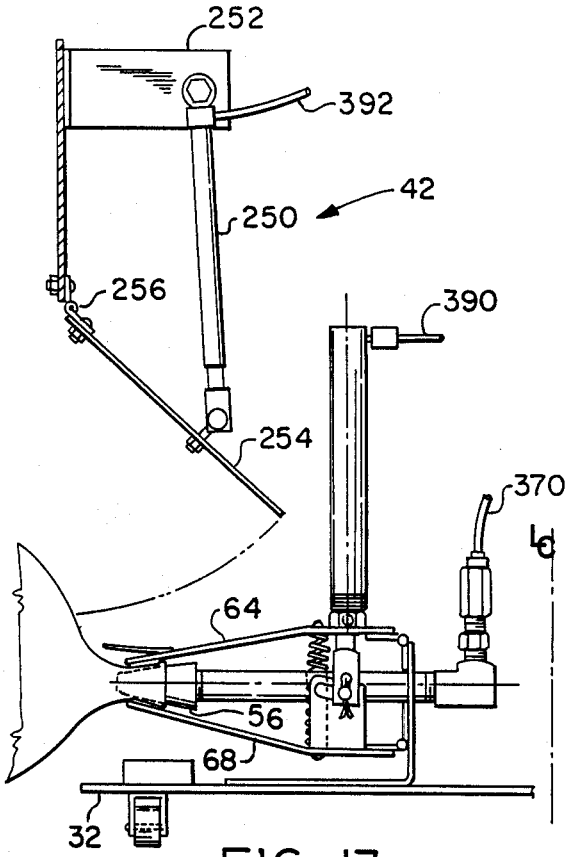
FIG. 13 is a view looking generally in the direction of arrows 13—13 of FIG. 12 and shown prior to discharge of the balloon.

At the discharge station 42 (FIGS. 12 and 13), air pressure is applied to pneumatic cylinder assembly 70 to begin to release the gripper fingers 64 and 68 from the neck of the balloon. At the same time, pneumatic pressure is applied to a discharge cylinder 250. Because the discharge cylinder 250 is of a smaller diameter than the cylinder assembly 70, the piston of discharge cylinder assembly 250 extends first.

Figure 14:
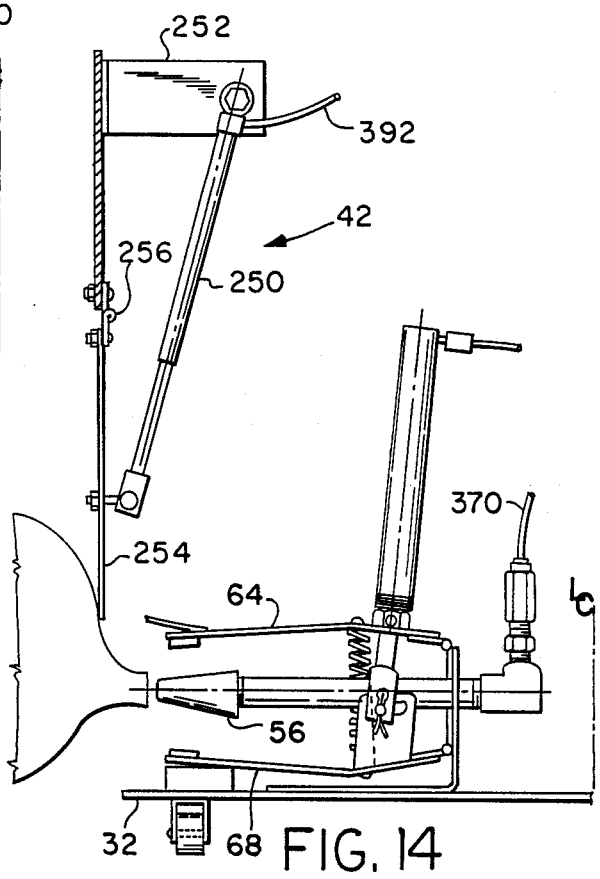
FIG. 14 is a view generally similar to FIG. 13 but showing the balloon in the process of being released.

The discharge cylinder 250 (FIG. 13) is mounted by means of a bracket 252 to the machine housing 37, and a discharge paddle 254 is connected to the bracket by means of a hinge 256. Upon extension of the discharge cylinder assembly 250, the discharge paddle 254 pivots downward from a retracted position (FIG. 13) and engages the side of the balloon (FIG. 14). At the same time as this contact is occurring, the gripper fingers 64 and 68 release the neck of the balloon from the nozzle tip 56. The combined effect of the air pressure within the balloon and the swat the balloon receives from the discharge paddle 254 separates the balloon from the discharge nozzle and directs it into the opening 260 (FIG. 1) which leads to the heater 44.

The heater 44 is located immediately below the opening 260 and comprises a pair of conveyor belts 262 and 264 driven by motors 266 and 268. The conveyor belts 262 and 264 are positioned so that the balloons travel the length of conveyor 262 and then drop onto conveyor belt 264 which is traveling in the opposite direction. An infrared heater 270 is positioned above the belt 264. The application of infrared radiation to the balloons serves to shrink them back to their original size and to assure complete drying of the ink image.

Figure 16:
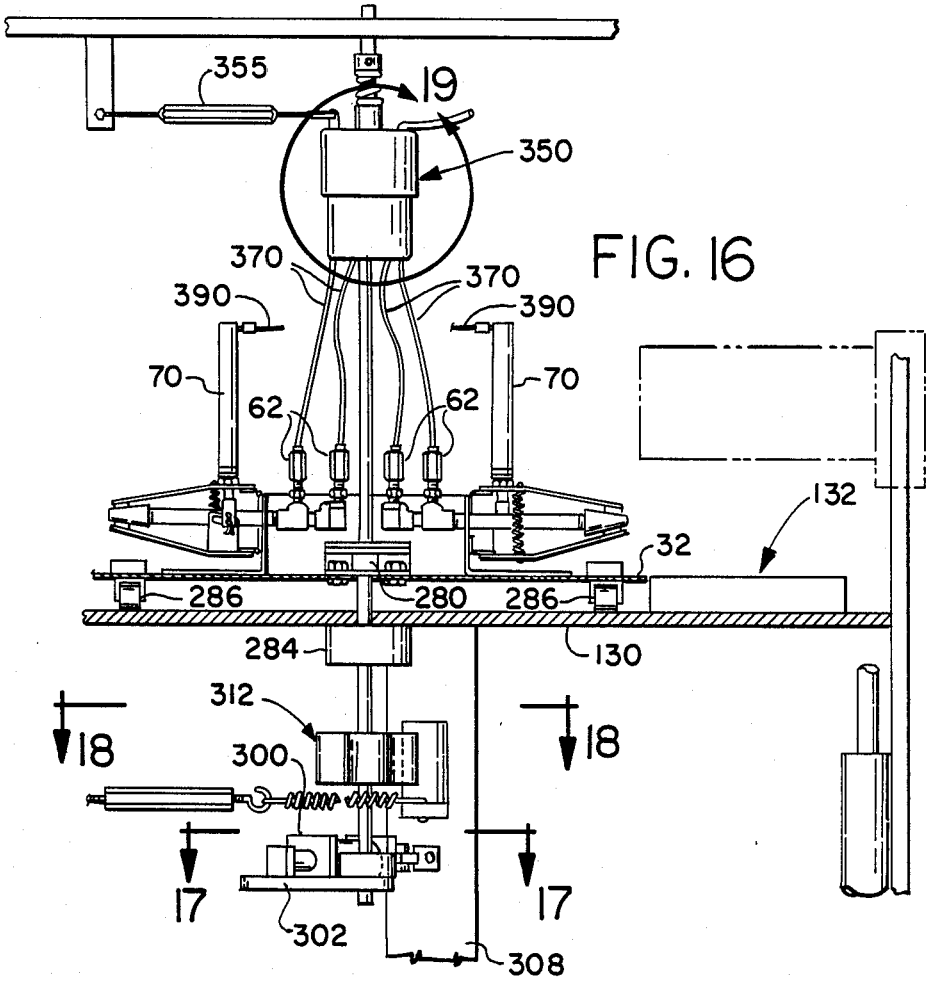
FIG. 16 is a sectional view generally looking in the direction of arrows 16—16 of FIG. 1.
Figure 17:
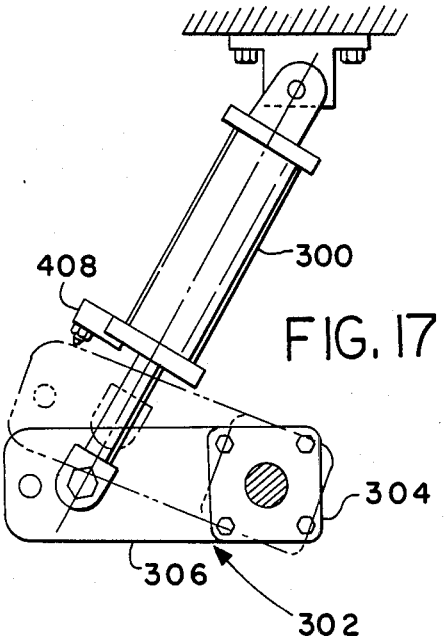
FIG. 17 is a view generally looking in the direction of arrows 17—17 of FIG. 16.
Figure 18:
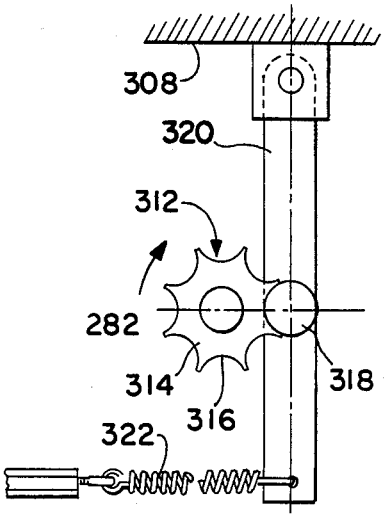
FIG. 18 is a view generally looking in the direction of arrows 18—18 of FIG. 16.
Figure 19:
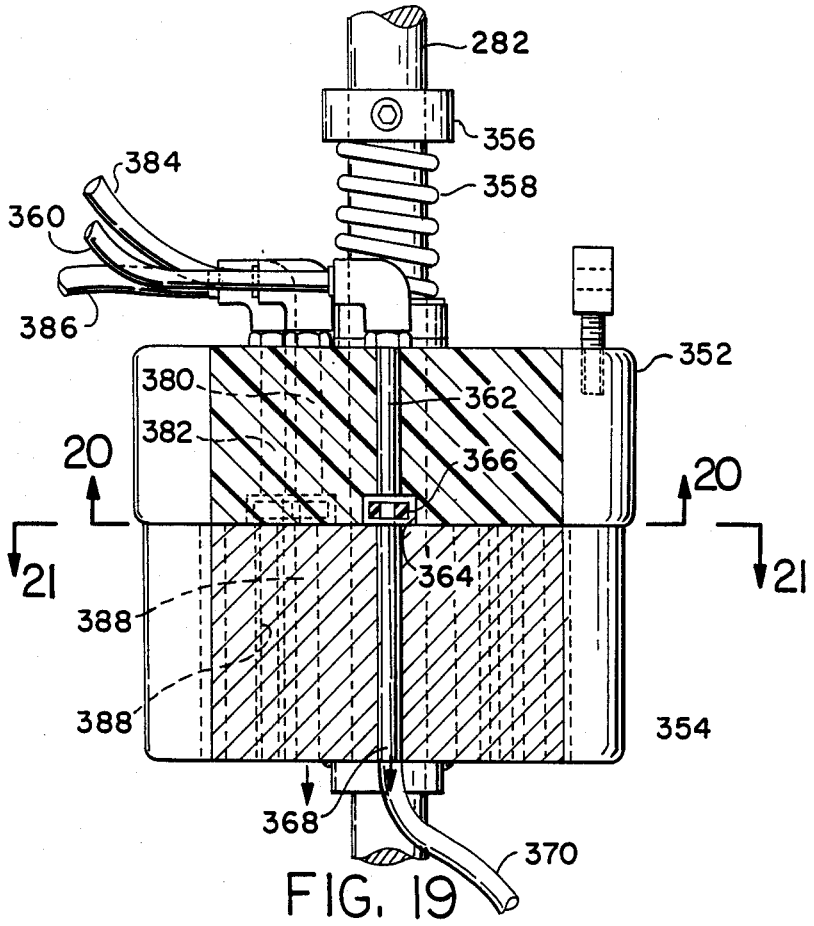
FIG. 19 is an enlarged, partly sectional view of a portion of FIG. 16.
Figure 20:
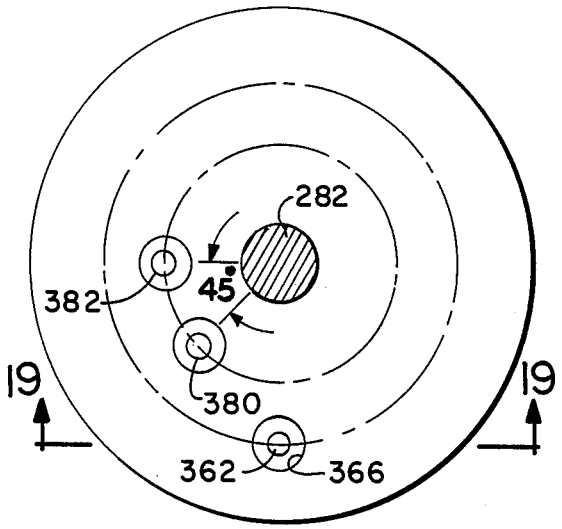
FIG. 20 is a view looking in the direction of arrows 20—20 of FIG. 19.
Figure 21:
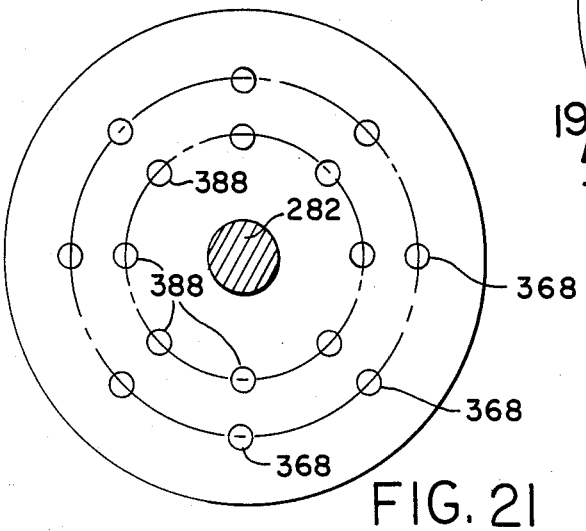
FIG. 21 is a view looking in the direction of arrows 21—21 of FIG. 19.

FIGS. 16–18 illustrate the mechanism used to advance the rotatable table 32 through the various positions previously described. The rotatable table 32 is mounted by means of a flange 280 to a vertical shaft 282. The shaft 282 is rotatably supported by bearings 284 which are in turn mounted to the plate 130. The rotatable table 32 further carries a number of support wheels 286 which are secured near the perimeter of the rotatable table 32 and roll on the support plate 130. As the shaft 282 is rotated, the table 32 also rotates.

Rotation of the table is effected by a cylinder 300 (FIG. 17) and ratchet assembly 302. The ratchet assembly 302 includes a ratchet mechanism 304 which is connected to the shaft 282 and an arm 306 extending radially from the ratchet mechanism. The cylinder 300 is connected between the frame of the machine 308 and the arm 306. Conventional pivotable connections are provided at either end of the cylinder 300. When the cylinder assembly is extended, the shaft 282 is rotated counterclockwise as viewed from above. As the cylinder assembly 300 retracts, the ratchet mechanism 304 permits the lever 306 to move without any accompanying movement of the shaft 282.

A detent mechanism 312 (FIG. 18) serves to assure that the shaft 282 and hence the table 32 stop at the precise proper location for each operation. The detent mechanism 312 includes a cam 314 which is formed with eight symmetrical pockets 316 around its perimeter. The cam 314 is fixed with respect to the shaft 282. A cam follower 318 is mounted on a lever arm 320. The lever arm in turn is pivotably mounted to the machine frame 308 at one end and at its other end a spring 322 serves to pull the cam follower into engagement with the cam 314. The cam follower 318 is shaped to fit in the pockets 316 and so serves as a detent to yieldably retain the shaft 282 against motion.

When the cylinder 300 (FIG. 17) is extended, the cam 314 rotates pressing the cam follower 318 outward as the crest of the cam pushes against the follower, then the cam follower falls down into the succeeding pocket 316 as the shaft continues to rotate. The length of the lever arm 306 and the location of the connection between it and the piston of cylinder assembly 300 serve to assure that the full stroke of the cylinder assembly corresponds very nearly to one-eighth of a revolution of the shaft 282. The detent mechanism 312 serves to accurately position the table at each station.

Air pressure to the varied cylinders and nozzles on the rotatable table is supplied through a distribution manifold 350 (FIGS. 16 and 19–21). Distribution manifold 350 includes a fixed input disc 352 and a rotatable output disc 354. The two discs are mounted coaxially on the shaft 282 with the output disc 354 being fixed with respect to the shaft 282 and below the input disc 352. A turnbuckle 355 serves to rotate the input disc 352 with respect to the machine frame to adjust the timing of functions controlled by the manifold 350.

A collar 356 clamped to the shaft 282 and a coil spring 358 serve to hold the input disc snugly against the output disc. The input disc 352 is formed of a slippery plastic such as Teflon while the output disc 354 is steel. The Teflon together with washers (366 discussed below) provides a smooth acting and airtight seal between these two parts.

There are three conduits leading in to the input disc 352. The first is the nozzle supply conduit 360. The nozzle supply conduit ultimately supplies air under pressure from solenoid 107 (FIG. 22) to the nozzle assembly 54. Nozzle supply conduit 360 is connected to a passage 362 through the input disc 352. This passage 362 has an enlarged lower end portion 364 which receives a flat rubber disc washer 366. The passage 362 is the same distance from the center of shaft 282 as eight passages 368 (FIGS. 19 and 21) in the output disc 354. When the passage 362 is aligned with one of the passages 368, and air pressure is applied to conduit 360, the washer 366 moves downward within the enlarged end portion 364 and is pressed against the face of the steel output disc 354 to seal against air leakage. Each of these passages 368 is connected to a conduit 370 which leads to a corresponding one of the check valves 62 (FIG. 16). Thus when one of the passages 368 is in alignment with the passage 362 and when air under pressure is supplied through conduit 360, air flows in a manner previously described into the balloon to fill the balloon.

A similar arrangement of internal passages through the input disc 352 and output disc 354 provide air pressure to the gripper means 34 to open the upper and lower gripper fingers 64 and 66 against the spring bias which tends to hold them closed. Specifically passages 380 and 382 (FIGS. 19 and 20) extend through input disc 352 and have enlarged end portions with washers. These passages 380 and 382 direct air from conduits 384 and 386, respectively, through two of eight uniformly spaced passages 388, through the output disc 354. Passages 380 and 382 are on a common radius from shaft 282 with the passages 388 and are separated by angle of 45°. Whichever one of the passages 388 is aligned with passage 380 directs air under pressure to the cylinder assembly 70 which is aligned with opening 36 (FIG. 1) in the housing 37 and therefore supplies air to open the gripper fingers 64 and 66 to permit a balloon to be put into the machine. Whichever of the passages 388 is aligned with passage 382 supplies air under pressure to the cylinder 70 at the discharge station 42 through conduits 390. The conduits 390 leading from passages 388 to the cylinders 70 have not been shown in their entirety to simplify the drawing.

The operation of the various cylinders is controlled by a circuit shown schematically in FIG. 22. When power is supplied to the pump 400 the index cylinder control 402 applies air pressure to the table index cylinder 300. This cylinder then extends and automatically retracts. When it has reached its full extension, a signal is passed through an operator safety switch 404 to the print station lift cylinder control 406. When the table index cylinder 300 is fully retracted, the arm 306 (FIG. 17) contacts a manifold air flow limit switch 408. The limit switch 408 is spring biased to a closed position, but when the arm 306 presses against it, it opens and allows air to flow to the distribution manifold 350 and from their, as discussed above, the air flows to the gripper cylinders 70 of the grippers which are aligned with the operator station and with the discharge station 42. In addition, air is supplied through conduit 392 to the discharge station paddle cylinder 250 of the gripper means which is aligned with the discharge station.

The fact that the manifold air flow limit switch 408 is normally closed means that whenever the table is moving (on account of the cylinder 300 being in the process of either being extended or being retracted) there is no air pressure supplied to the distribution manifold 350. For this reason, there is no air force tending to press the washers 360 which float within the enlarged end portions of passages 362 against the moving steel cylinder 354. This greatly reduces wear on the washers, especially as compared to an alternate design possibility of using rubber O-rings surrounding the various ports.

The operator safety switch 404 is connected with a paddle 410 (FIG. 1) mounted in the opening 36 through which the operator must reach to insert a balloon on the nozzle 56 (FIG. 2). The paddle 410 is mounted on a hinge at its lower edge and is spring biased to the position shown in FIG. 1. The paddle 410 is shaped so that it must be depressed whenever hands are inside the machine. When the paddle 410 is depressed, the operator safety switch moves from a normally closed position to an open position and thus precludes transmission of a signal from the index cylinder control 402 to the print station lift cylinder control 406. This prevents any further cycling of the machine until the operator's hands are removed from the window 36 and the paddle 410 returned to its unpressed position.

Once the operator safety switch 404 has returned to its normally closed position, a signal from the index cylinder control 402 is passed to the print station lift cylinder control 406. This signal causes the print station lift cylinder 150 to lower the screen frame assembly 138 to the position shown in FIG. 7B. When this occurs, the print station lift cylinder control 406 sends a signal to the reciprocating carriage cylinder control 412. This signal causes the reciprocating carriage cylinder control to begin the motion of the reciprocating carriage cylinder 174. As discussed previously, when the reciprocating carriage cylinder 174 begins motion in either direction, one of the squeegee limit switches 180 or 182 (depending on the direction of motion of the reciprocating carriage cylinder 174) returns to its closed position. The other of the squeegee limit switches 180 and 182 was already closed. The closing of the squeegee limit switch 180, 182 causes the squeegee up/down cylinder 178 to be supplied with air pressure which consequently presses the wiper or squeegee assembly 176 downward bringing the rubber squeegee 214 into contact with the silk screen 136.

When the reciprocating carriage cylinder 174 reaches the end of its stroke, the print station lift cylinder control 406 automatically actuates the print station lift cylinder 150 to lift the print station to the position shown in FIG. 7A and at the same time a signal is sent to the index cylinder control 402 to actuate the table index cylinder 300. The cycle then repeats itself.

Because it is occasionally necessary to cycle the machine without printing on balloons, a squeegee on/off switch 414 is provided in series with limit switches 180 and 182. If the switch is turned off, no air can be supplied to the squeegee up/down cylinder 178, and consequently the wiper or squeegee assembly 176 remains in its uppermost position and no ink is pressed through the silk screen onto the balloon.

What is claimed is:

1. A balloon printing machine comprising a horizontal rotatable table, gripper means mounted to the table for holding a balloon in a fixed position relative to the table, said gripper means including means for inflating the balloon and means for retaining air in the inflated balloon, means for controlling the amount of air in the balloon as a function of the inflated balloon's size, print station means for printing an image on the balloon, the print station means including a generally horizontal silk screen, a balloon support surface coplanar with the table, means for supporting the silk screen cantilevered over the balloon support surface, means for moving the silk screen vertically with respect to the table into contact with the balloon at the print station to press the balloon against the balloon support, and wiper means for pressing ink through the silk screen onto the balloon while the silk screen is in contact with the balloon, discharge station means for releasing the balloon from the gripper means, and indexing means for incrementally advancing the table to sequentially move the balloon past the print station means to the discharge station means.

2. The apparatus of claim 1 wherein the print station means includes means for bringing the wiper means into and out of contact with the silk screen.

3. The apparatus of claim 1 wherein the print station means includes means for positioning the wiper means at a first angle with respect to a plane defined by the silk screen or at a second angle with respect to the plane defined by the silk screen.

4. The apparatus of claim 3 wherein the first and second angles are approximately equal and oppositely disposed about a plane normal to the plane defined by the silk screen.

5. The apparatus of claim 1 wherein the print station means includes means for moving the wiper means vertically with respect to the silk screen.

6. The apparatus of claim 5 including actuator means for moving the wiper means across the silk screen and control means for holding the wiper means vertically spaced from the silk screen until after the actuator means begins movement of the wiper means across the silk screen and thereafter moving the wiper means downward into contact with the silk screen.

7. The apparatus of claim 1 wherein the vertical movement of the silk screen is parallel to the axis of rotation of the rotatable table.

8. The apparatus of claim 1 wherein the wiper means includes means for moving a squeegee in a direction parallel to a line extending from the neck of the balloon to the apex of the balloon.

9. A balloon printing machine including means for inflating a balloon and for controlling the amount of air in the balloon as a function of the inflated balloon's size, a horizontal work surface, positioning means for moving an inflated balloon laterally onto and off of the work surface and for holding the balloon on the work surface, the work surface having a front edge and side edges connecting with the front edge, the positioning means moving laterally along the front edge of the work surface to move and hold the balloon, the balloon extending outward from the positioning means and passing over both the front edge and a side edge as the balloon is moved onto the work surface, and print station means for printing an image on the inflated balloon, the print station means having a silk screen, a frame for mounting the silk screen and means for moving the silk screen and frame vertically between a first position spaced from the balloon and work surface and a second position in which the balloon is flattened between the work surface and the silk screen, the means for moving the silk screen and frame vertically including vertical rails extending upright from a rear edge of the work surface generally opposite the front edge of the work surface, the frame and work surface defining therebetween a space unobstructed along all edges of the work surface except the rear edge thereby permitting the balloon to be moved across both the front and the side edges as the balloon is moved laterally onto and off of the work surface by the positioning means.

10. The machine of claim 9 wherein the print station means includes wiper means having a blade extending widthwise of the silk screen for pressing ink through the silk screen onto the balloon, first actuator means for moving the wiper means back and forth lengthwise of the silk screen, and the wiper means further including second actuator means for moving the blade into and out of engagement with the silk screen.

11. The machine of claim 10 wherein the wiper means includes a wiper blade, hinge means for pivoting the wiper blade to either side of a central, vertical position, and biasing means urging the wiper blade to the central, vertical position.

12. The machine of claim 11 including control means for controlling the second actuator means to keep the blade out of engagement with the silk screen until the first actuator means begins lengthwise movement of the wiper means.

13. The machine of claim 11 further including stop means for limiting the extent of movement of the wiper blade from its central vertical position.

* * * * *